US007913844B2

(12) United States Patent
Spivey, Sr.

(10) Patent No.: US 7,913,844 B2
(45) Date of Patent: Mar. 29, 2011

(54) ARTICLE CARRIER WITH RETENTION FEATURES

(75) Inventor: Raymond R. Spivey, Sr., Mableton, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 12/685,077

(22) Filed: Jan. 11, 2010

(65) Prior Publication Data

US 2010/0133330 A1 Jun. 3, 2010

Related U.S. Application Data

(63) Continuation of application No. PCT/US2008/071134, filed on Jul. 25, 2008.

(60) Provisional application No. 60/952,095, filed on Jul. 26, 2007.

(51) Int. Cl.
*B65D 75/00* (2006.01)
*B65D 5/42* (2006.01)

(52) U.S. Cl. ..... 206/434; 206/427; 229/198.2

(58) Field of Classification Search ..... 206/427–429, 206/434; 229/103.2, 198.2
See application file for complete search history.

(56) References Cited

U.S. PATENT DOCUMENTS 2,849,111 A 8/1958 Fielding
RE24,667 E * 7/1959 Fielding ..... 206/182
2,922,561 A 1/1960 Currivan
2,928,541 A 3/1960 Fielding
2,929,497 A * 3/1960 De Million-Czarnecki .. 206/427
3,178,242 A 4/1965 Ellis
3,237,762 A 3/1966 Wood
3,300,115 A 1/1967 Schauer
3,306,519 A 2/1967 Wood
3,339,723 A 9/1967 Wood
3,356,279 A 12/1967 Root
3,373,867 A 3/1968 Wood
3,517,858 A * 6/1970 Farquhar ..... 206/427
3,593,849 A 7/1971 Helms (Continued)

FOREIGN PATENT DOCUMENTS

BE 671 762 3/1966

(Continued)

OTHER PUBLICATIONS

International Search Report and Written Opinion for related application PCT/US2008/071134, mailed Feb. 17, 2009.

*Primary Examiner* — Bryon P Gehman
(74) *Attorney, Agent, or Firm* — Womble Carlyle Sandridge & Rice, PLLC

(57) ABSTRACT

A carton for carrying a plurality of articles. The carton comprises a top panel, at least one side panel foldably connected to the top panel at a first line of weakening, and a top retainer foldably connected to the top panel and the at least one side panel. The top retainer comprises a top retention panel foldably connected to the top panel at a second line of weakening, a side retention panel foldably connected to the top retention panel at a portion of the first line of weakening, and a tuck-in panel foldably connected to the at least one side panel at a third line of weakening, the second line of weakening and the third line of weakening each comprising a cut/crease line having at least one cut portion and at least one score line portion.

21 Claims, 9 Drawing Sheets

U.S. PATENT DOCUMENTS

| | | | |
|---|---|---|---|
| 3,635,452 | A | 1/1972 | Helms |
| 3,669,343 | A | 6/1972 | Howard |
| 3,747,835 | A | 7/1973 | Graser |
| 3,767,042 | A | 10/1973 | Ganz |
| 3,963,121 | A | 6/1976 | Kipp |
| 4,010,593 | A | 3/1977 | Graham |
| 4,096,985 | A | 6/1978 | Wood |
| 4,101,069 | A | 7/1978 | Wood |
| 4,202,446 | A | 5/1980 | Sutherland |
| 4,328,893 | A | 5/1982 | Oliff et al. |
| 4,394,903 | A | 7/1983 | Bakx |
| 4,421,232 | A | 12/1983 | Konaka |
| 4,424,901 | A | 1/1984 | Lanier |
| 4,440,340 | A | 4/1984 | Bakx |
| 4,566,593 | A | 1/1986 | Muller |
| 4,747,487 | A | 5/1988 | Wood |
| 4,784,266 | A | 11/1988 | Chaussadas |
| 4,804,089 | A | 2/1989 | Wilson |
| 4,860,943 | A | 8/1989 | Cooper |
| 4,875,585 | A | 10/1989 | Kadleck et al. |
| 4,901,849 | A | 2/1990 | Wilson |
| 4,919,266 | A | 4/1990 | McIntosh, Jr. et al. |
| 4,966,324 | A | 10/1990 | Steel |
| 4,972,991 | A | 11/1990 | Schuster |
| 5,000,313 | A | 3/1991 | Oliff |
| 5,042,660 | A | 8/1991 | Carver |
| 5,060,792 | A | 10/1991 | Oliff |
| 5,131,588 | A | 7/1992 | Oliff |
| 5,180,100 | A | 1/1993 | Shimizu |
| 5,195,676 | A | 3/1993 | LeBras |
| 5,246,112 | A | 9/1993 | Stout et al. |
| 5,297,673 | A | 3/1994 | Sutherland |
| 5,351,878 | A | 10/1994 | Cooper |
| 5,421,458 | A | 6/1995 | Campbell |
| 5,443,203 | A | 8/1995 | Sutherland |
| 5,472,090 | A | 12/1995 | Sutherland |
| 5,472,138 | A | 12/1995 | Ingram |
| 5,485,915 | A | 1/1996 | Harris |
| 5,505,372 | A | 4/1996 | Edson et al. |
| 5,542,536 | A | 8/1996 | Sutherland |
| 5,551,556 | A | 9/1996 | Sutherland |
| 5,558,212 | A | 9/1996 | Sutherland |
| 5,558,213 | A | 9/1996 | Sutherland |
| 5,597,071 | A | 1/1997 | Sutherland |
| 5,609,251 | A | 3/1997 | Harris |
| 5,664,401 | A | 9/1997 | Portrait et al. |
| 5,682,995 | A | 11/1997 | Sutherland |
| 5,692,614 | A | 12/1997 | Harris |
| 5,704,542 | A | 1/1998 | Harrelson |
| 5,782,343 | A | 7/1998 | Harrelson |
| 5,788,630 | A | 8/1998 | Portrait et al. |
| 5,853,088 | A | 12/1998 | Saulas et al. |
| 5,855,318 | A | 1/1999 | Baxter |
| 5,931,300 | A | 8/1999 | Sutherland |
| 5,937,620 | A | 8/1999 | Chalendar |
| 5,941,453 | A | 8/1999 | Oliff |
| 5,943,847 | A | 8/1999 | Chalendar |
| 5,947,367 | A | 9/1999 | Miller et al. |
| 5,975,286 | A | 11/1999 | Oliff |
| 6,019,220 | A | 2/2000 | Sutherland |
| 6,021,898 | A | 2/2000 | Sutherland |
| 6,021,899 | A | 2/2000 | Sutherland |
| 6,109,438 | A | 8/2000 | Sutherland |
| 6,155,480 | A | 12/2000 | Botsford et al. |
| 6,158,586 | A | 12/2000 | Muller |
| 6,227,367 | B1 | 5/2001 | Harrelson et al. |
| 6,283,293 | B1 | 9/2001 | Lingamfelter |
| 6,289,651 | B1 | 9/2001 | Le Bras |
| 6,315,123 | B1 | 11/2001 | Ikeda |
| 6,378,765 | B1 | 4/2002 | Sutherland |
| 6,550,616 | B2 | 4/2003 | La Bras |
| 6,789,673 | B2 | 9/2004 | Lingamfelter |
| 6,811,525 | B2 | 11/2004 | Culpepper |
| 6,866,185 | B2 | 3/2005 | Harrelson |
| 6,948,651 | B2 | 9/2005 | Ikeda |
| 6,981,631 | B2 | 1/2006 | Fogle et al. |
| 6,988,617 | B2 | 1/2006 | Gomes et al. |
| 7,007,800 | B2 | 3/2006 | Le Bras |
| 7,025,197 | B2 | 4/2006 | Sutherland |
| 7,159,759 | B2 | 1/2007 | Sutherland |
| 7,175,020 | B2 | 2/2007 | Sutherland et al. |
| 7,427,010 | B2 * | 9/2008 | Sutherland ..... 229/198.2 |
| 7,448,492 | B2 | 11/2008 | Sutherland |
| 7,644,817 | B2 | 1/2010 | Sutherland |
| 7,677,387 | B2 | 3/2010 | Brand et al. |
| 7,762,395 | B2 * | 7/2010 | Sutherland et al. ..... 206/427 |
| 7,762,397 | B2 | 7/2010 | Coltri-Johnson et al. |
| 2003/0000182 | A1 | 1/2003 | Portrait et al. |
| 2003/0132130 | A1 | 7/2003 | Le Bras |
| 2004/0000582 | A1 | 1/2004 | Sutherland |
| 2004/0011674 | A1 | 1/2004 | Theelen |
| 2004/0089671 | A1 | 5/2004 | Miller |
| 2004/0188277 | A1 | 9/2004 | Auclair |
| 2004/0188301 | A1 | 9/2004 | Gomes |
| 2004/0243277 | A1 | 12/2004 | Bonnain et al. |
| 2004/0254666 | A1 | 12/2004 | Bonnain et al. |
| 2005/0001020 | A1 | 1/2005 | Garnier |
| 2005/0167290 | A1 | 8/2005 | Sutherland |
| 2005/0178791 | A1 | 8/2005 | Miller |
| 2005/0194430 | A1 | 9/2005 | Auclair et al. |
| 2006/0157545 | A1 | 7/2006 | Auclair |
| 2006/0191811 | A1 | 8/2006 | Fogle et al. |
| 2006/0255108 | A1 | 11/2006 | Shmagin |
| 2010/0072267 | A1 | 3/2010 | May |

FOREIGN PATENT DOCUMENTS

| | | | |
|---|---|---|---|
| DE | 91 04 905.9 | | 6/1991 |
| DE | 92 03 858.1 | | 5/1992 |
| EP | 459 658 | A1 | 12/1991 |
| EP | 509 749 | A1 | 10/1992 |
| EP | 520 411 | A1 | 12/1992 |
| FR | 2 698 074 | | 5/1994 |
| JP | 41-18199 | | 10/1965 |
| JP | 5-112373 | | 5/1993 |
| WO | WO 97/27124 | | 7/1997 |
| WO | WO 02/102208 | A1 | 12/2002 |
| WO | WO 03/008292 | A2 | 1/2003 |
| WO | WO2004/087507 | | 10/2004 |
| WO | WO2005 092735 | | 10/2005 |
| WO | WO 2005/042370 | A1 | 12/2005 |
| WO | WO 2007/126977 | A3 | 11/2007 |
| WO | WO 2009/015320 | A2 | 1/2009 |

* cited by examiner

ARTICLE CARRIER WITH RETENTION FEATURES

CROSS-REFERENCE TO RELATED APPLICATIONS

This application is a continuation application of prior PCT Application No. PCT/US2008/071134, filed Jul. 25, 2008, entitled "Carrier With Retention Features," which PCT application claims the benefit of U.S. Provisional Application No. 60/952,095, filed on Jul. 26, 2007.

INCORPORATION BY REFERENCE

The entire disclosures of PCT Application No. PCT/US2008/071134, filed Jul. 25, 2008, and U.S. Provisional Application No. 60/952,095, filed Jul. 26, 2007, are incorporated by reference as if set forth in their entireties.

BACKGROUND OF THE DISCLOSURE

The present disclosure generally relates to carriers for holding and dispensing beverage containers or other types of articles.

SUMMARY OF THE DISCLOSURE

In general, one aspect of the disclosure is directed a carton for carrying a plurality of articles. The carton comprises a top retainer comprising a top retention panel, a side retention panel, and a tuck-in panel. The top retention panel, side retention panel, and tuck-in panel are joined at an intersection of lines of weakening. The intersection comprises at least two cut portions of respective lines of weakening and at least one fold line.

In another aspect, the disclosure is directed to a method of forming a carton from a blank as shown and/or described herein.

In another aspect, the disclosure is generally directed to a carton for carrying a plurality of articles. The carton comprises a top panel, a side panel foldably connected to the top panel at a first line of weakening, and a top retainer foldably connected to the top panel and the side panel. The top retainer comprises a top retention panel foldably connected to the top panel at a second line of weakening, a side retention panel foldably connected to the top retention panel at a portion of the first line of weakening, and a tuck-in panel foldably connected to the at least one side panel at a third line of weakening. The second line of weakening and the third line of weakening each comprise a cut-crease line having at least one cut portion and at least one score line portion.

In another aspect, the disclosure is generally directed to a blank for forming a carton for holding a plurality of articles. The blank comprises a top panel, a side panel foldably connected to the top panel at a first line of weakening, and retainer features foldably connected to the top panel and the at least one side panel. The retainer features comprise a top retention panel foldably connected to the top panel at a second line of weakening, a side retention panel foldably connected to the top retention panel at a portion of the first line of weakening, and a tuck-in panel foldably connected to the at least one side panel at a third line of weakening. The second line of weakening and the third line of weakening each comprise a cut-crease line having at least one cut portion and at least one score line portion.

Other aspects, features, and details of the present disclosure can be more completely understood by reference to the following detailed description of exemplary embodiments taken in conjunction with the drawings and from the appended claims.

Those skilled in the art will appreciate the above stated advantages and other advantages and benefits of various additional embodiments reading the following detailed description of the embodiments with reference to the below-listed drawing figures. Further, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to various features for cartons or carriers that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons or carriers according to the present disclosure can accommodate articles of any shape. For the purpose of illustration and not for the purpose of limiting the scope of the disclosure, the following detailed description describes beverage containers (e.g., aluminum beverage cans) as disposed within the carrier embodiments. In this specification, the terms "lower," "bottom," "upper" and "top" indicate orientations determined in relation to fully erected and upright cartons.

Figure 1:
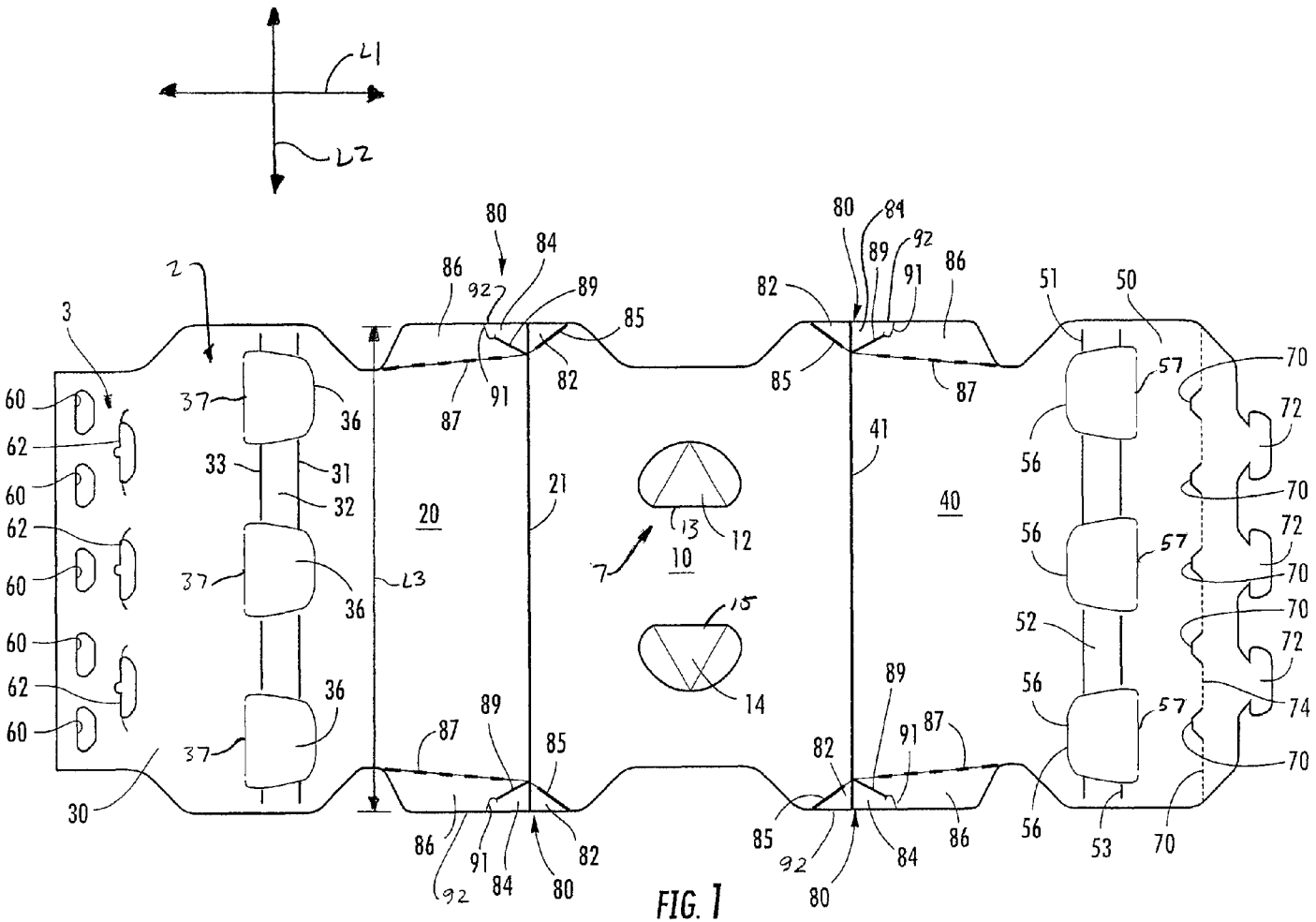
FIG. 1 is a plan view of an exterior surface of a blank used to form a carton according to a first embodiment of the disclosure.
Figure 3:
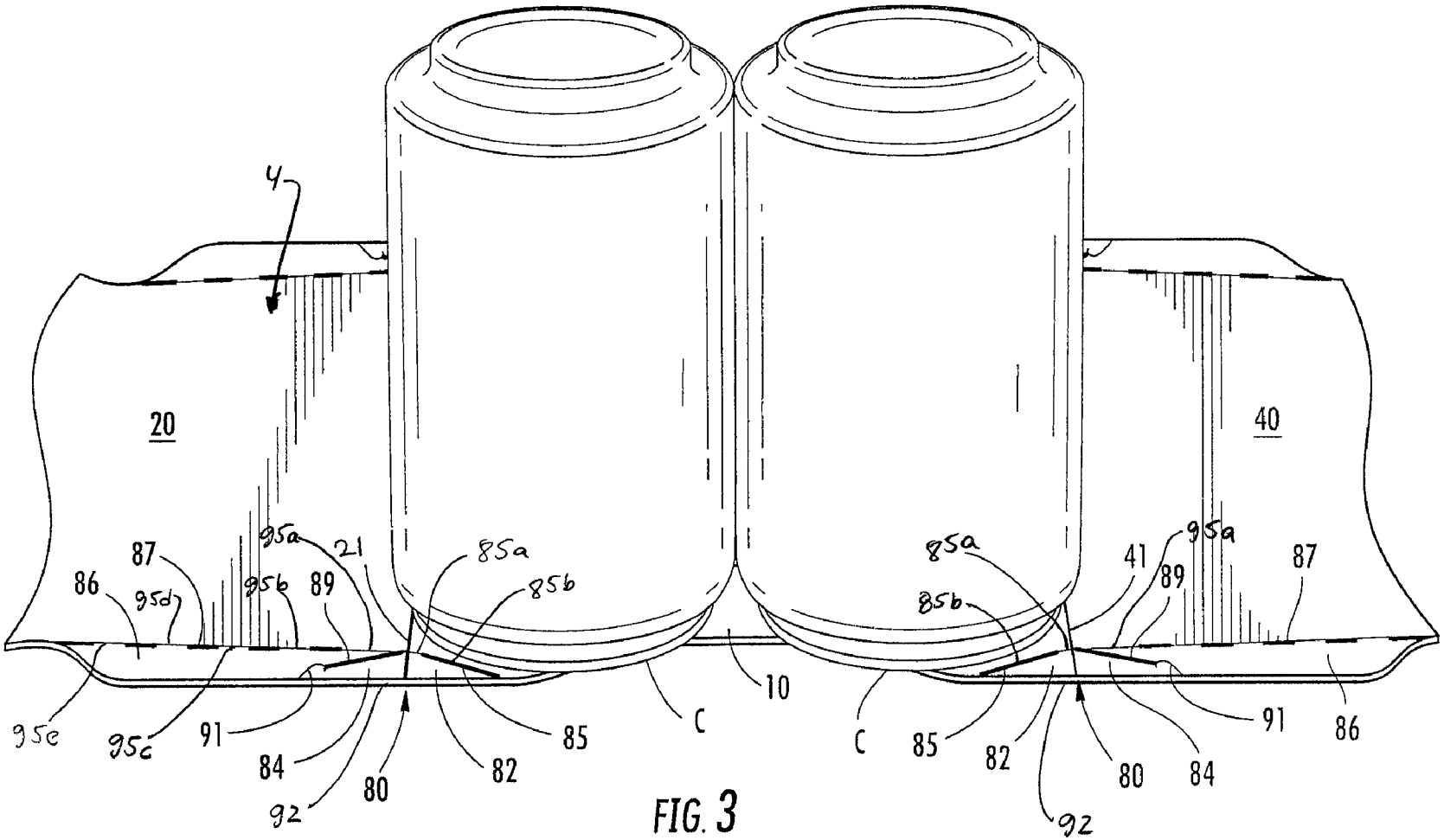
FIG. 3 is an enlarged portion of FIG. 2.
Figure 6:
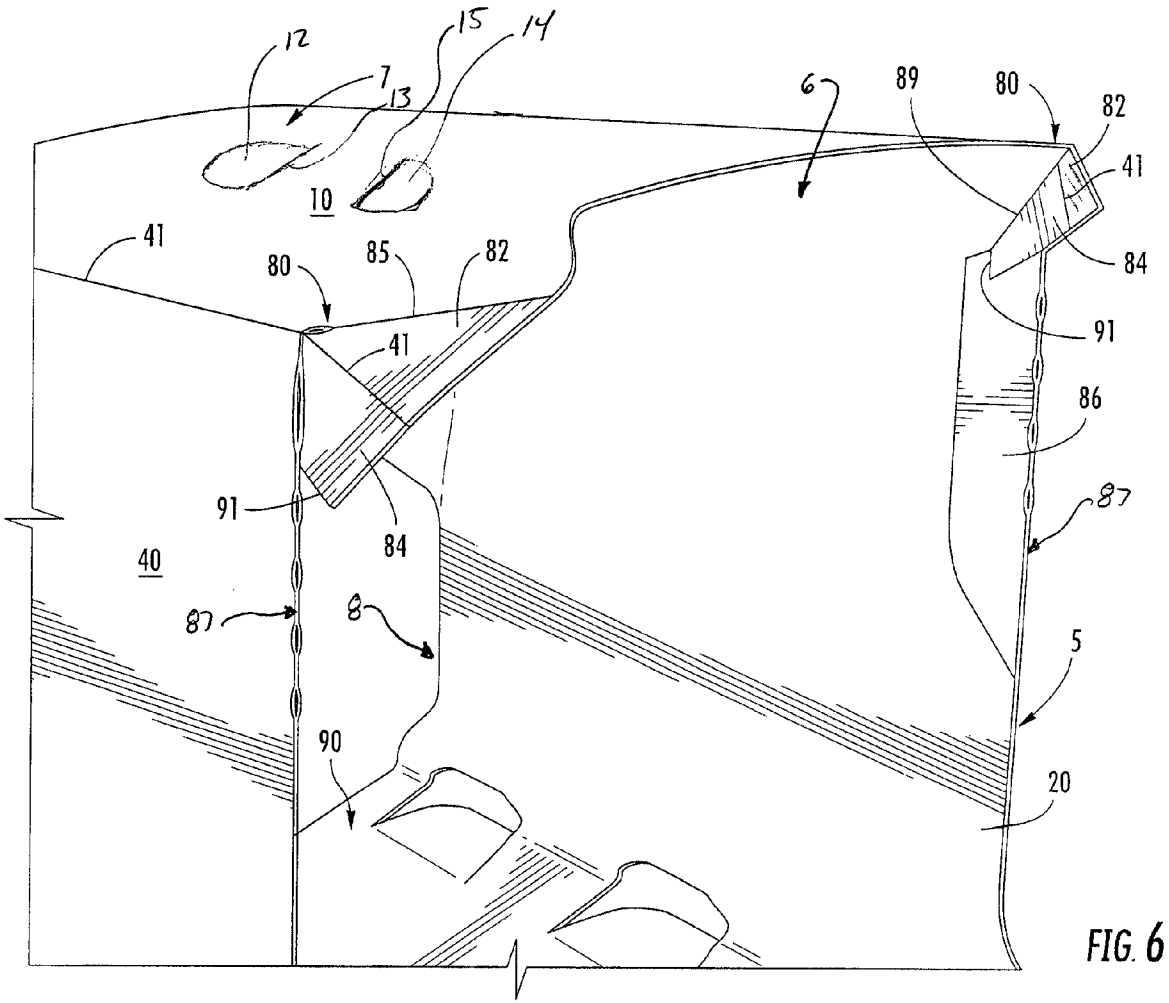
FIG. 6 is a perspective of a top of the carton with containers removed to show internal details of the carton.

FIG. 1 is a plan view of an exterior surface 2 of a blank 3, used to form a carton 5 (FIG. 4) according to a first embodiment of the disclosure. The carton 5 can be used to house a plurality of articles such as containers C (FIG. 3). In the illustrated embodiment, the containers C are beverage cans and the carton 5 is sized to house six containers in a single layer in a 2×3 arrangement. But, it is understood that the carton 5 may be sized and shaped to hold containers C of a different or same quantity in more than one layer and/or in different row/column arrangements (e.g., 1×6, 2×6, 2×4, 2×2, 2×6×2, 2×4×2, 2×9, etc.). In the illustrated embodiment, the carton 5 is a carrier having generally open ends 6, 8 (FIG. 6)

that wraps around the containers C (e.g., the carton 5 may be referred to as a wrap-around carton). The carton 5 could be otherwise shaped and arranged such the ends 6, 8 are at least partially closed such as by end flaps (not shown) or other closing mechanisms.

The blank 3 has a longitudinal axis L1 and a lateral axis L2. In the illustrated embodiment, the blank 3 comprises a top panel 10 foldably connected to a first side panel 20 at a first lateral fold line 21, a first bottom panel 30 foldably connected to the first side panel 20 at a second lateral fold line 31, a second side panel 40 foldably connected to the top panel 10 at a third lateral fold line 41, and a second bottom panel 50 foldably connected to the second side panel 40 at a fourth lateral fold line 51. In the illustrated embodiment, the first bottom panel 30 includes a first bevel panel 32 defined by lateral fold lines 33 and 31. The second bottom panel 50 includes a second bevel panel 52 defined by lateral fold lines 51 and 53.

The first bottom panel 30, which is the inner bottom panel flap in the assembled carton 5, includes cutouts forming primary female locking edges 60 that are shaped and positioned to engage primary male locking tab projections 70 on the second bottom panel 50. The first bottom panel 30 also includes slits 62 shaped and positioned to receive outer secondary locking tab projections 72 of the second bottom panel 50. The second bottom panel 50, which is the outer bottom panel in the completed carton 5, includes a lateral fold line 74 which is interrupted by the slits that define the primary male locking tab projections 70. Although the locking elements of the blank 3 are illustrated to demonstrate a typical bottom panel locking arrangement suitable for use with the carton 5 (FIG. 5), it is understood that any alternative form of bottom panel locking structure may be employed without departing from the disclosure.

In one embodiment, slits at least partially define heel cutout panels 36 that are foldably attached to the first bottom panel 30 at lateral fold lines 37. Each heel cutout panel 36 is sized to receive a bottom peripheral edge of a container C loaded in the carton 5. Similarly, heel cutout panels 56 are foldably attached to the second bottom panel 50 at lateral fold lines 57. In FIG. 1, the blank 3 includes three heel cutout panels 36, 56 in each bottom panel 30, 50, which are arranged to accommodate the six containers C in a 2×3 (two columns and three rows) arrangement. Alternatively, the heel cutout panels 36, 56 may be otherwise arranged and positioned in the blank, or the heel cutout panels may be omitted without departing from the scope of the disclosure.

As shown in FIG. 1, the blank 3 includes handle features for forming a handle 7 in the carton 5. The handle features include a first finger flap 12 and a second finger flap 14, each respectively formed by slits and foldably attached to the top panel 10 at respective longitudinal fold lines 13, 15. The handle 7 could include other features for carrying the carton 5, the finger flaps 12, 14 could be omitted or otherwise shaped and arranged, or the handle 7 could be omitted from the carton.

Figure 1A:
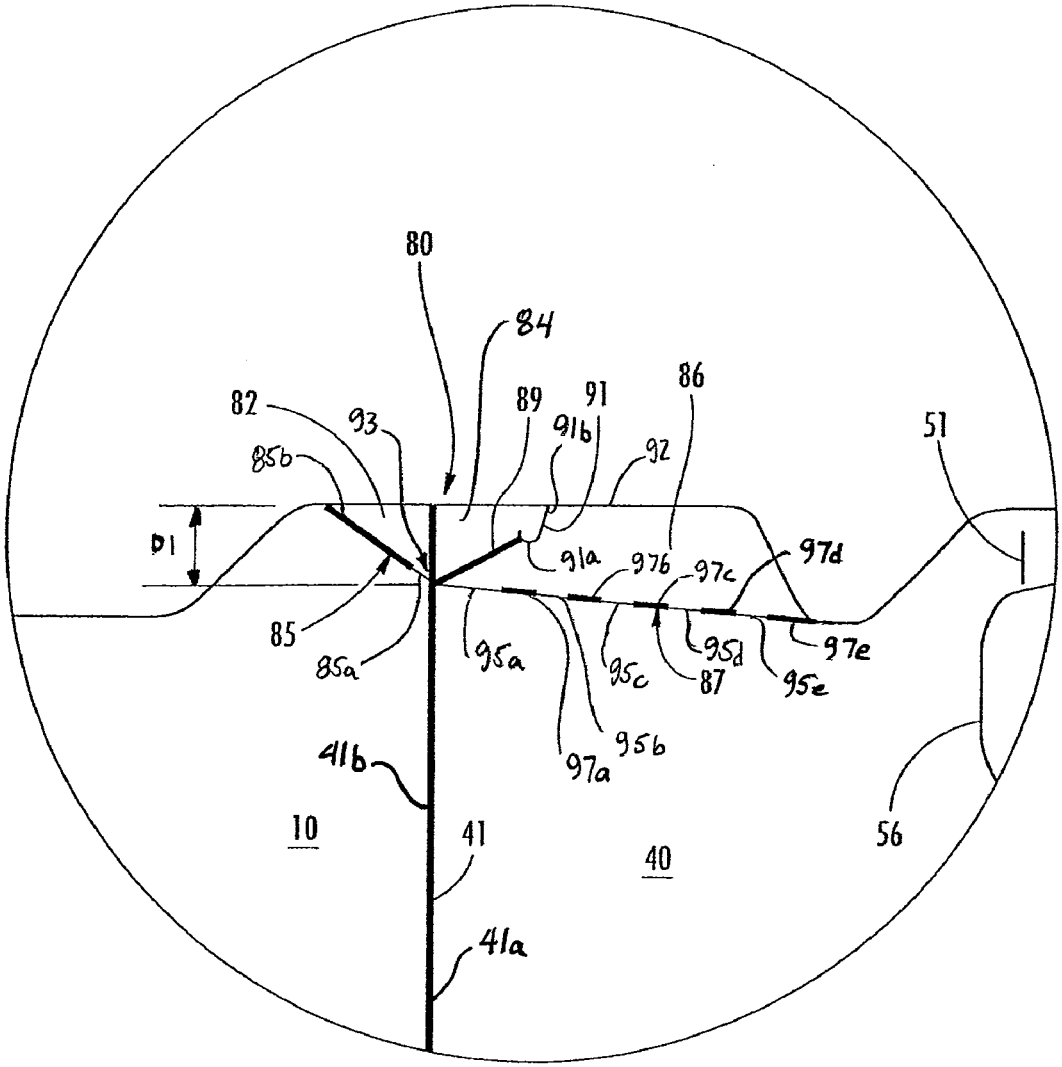
FIG. 1A is an enlarged portion of FIG. 1.

In the illustrated embodiment, the top panel 10 is generally rectangular having top retainer features in the form of a top retainer 80 located at each corner. The top retainers 80 each include a top retention panel 82 foldably attached to the top panel 10 at an oblique line of weakening 85 (e.g., fold line), a side retention panel 84 foldably attached to the top retention panel at a portion of one of the lateral fold lines 21, 41, and a tuck-in panel 86 foldably attached to one of the side panels 20, 40 at a second oblique line of weakening 87 (e.g., fold line). Each tuck-in panel 86 is foldably attached to a respective side retention panel 84 at a third oblique line of weakening line 89 (e.g., fold line). In the embodiment of FIG. 1, each tuck-in panel 86 and side retention panel 84 are separated by a cut 91 extending from the oblique line of weakening 89 to an edge 92 of the blank 3. As shown in FIG. 1A, the cut 91 is a generally J-shaped slit so that the cut has a curved portion 91*a* adjacent the line of weakening 89 and a straight portion 91*b* extending to the edge 92 of the blank 3. Alternatively, the cut 91 (e.g., slit) could be other shapes without departing from the disclosure.

In the illustrated embodiment, the oblique line of weakening 87 comprises a cut-crease line that includes cut portions 95*a* through 95*e* and score line portions 97*a* through 97*e*. In on embodiment, the line of weakening 87 includes five cut portions 95*a* through 95*e* and six score line portion 97*a* through 97*e* but the line of weakening 87 could be otherwise formed. Each cut portion 95*a* through 95*e* comprises a cut that extends substantially through the thickness of the blank to cause the blank 3 to tear or form an opening 98*a* through 98*e* (FIG. 4) when the blank is formed into the carton 5. Each score line portion 97*a* through 97*e* comprises an indentation in a surface of the blank that does not extend substantially through the thickness of the blank 3 so that the blank does not tear or separate along the length of the score line. As shown in FIG. 1A, one of the cut portions 95*a* of the line of weakening 87 intersects the lateral fold line 41 at a location that is adjacent to a first edge 41*a* (FIG. 1A) of the lateral fold line 41. Throughout this disclosure, each cut and cut portion may more specifically be in the form of a slit.

In the illustrated embodiment, the line of weakening 85 is a cut-crease line that includes a cut portion 85*a* and a score line portion 85*b*. As shown in FIG. 1A, the cut portion 85*a* intersects the lateral fold line 41 at a location that is adjacent to a second edge 41*b* (FIG. 1A) the lateral fold line 41. The cut portions 95*a*, 85*a* may extend into and intersect portions of the lateral fold lines 21, 41 or the cut portions 95*a*, 85*a* may terminate at a location that is adjacent and/or abutting the lateral fold lines 21, 41. The cut portion 85*a* forms an opening 94 (FIG. 4) when the blank 3 is formed into the carton 5. A portion of the lateral fold line 21, 41 between the cut portions 95*a*, 85*a* forms a section of material 22 (FIG. 4) between the openings 98*a*, 94 formed by the respective cut portions. The score line portions 97*a* through 97*e* of the line of weakening 87 form respective sections of material between the openings 98*a* through 98*e* formed from the cut portions 95*a* through 95*e*.

In the illustrated embodiments the lateral fold lines 21, 41 and oblique fold lines 89 are lines of weakening in the form of score lines that comprise an indentation in a surface of the blank 3 that does not extend substantially through the thickness of the blank so that the blank does not tear or separate along the length of the score line. The lines of weakening 21, 41, 89 could be other than illustrated (e.g., continuous cut-score lines, intermittent cut-score lines, etc.) without departing from the disclosure.

In the illustrated embodiment, the cut portion 95*a* of the line of weakening 87 intersects the lateral fold lines 21, 41 at an intersection 93 spaced from the edge 92 of the blank 3 by a first distance D1. As shown in FIG. 1A, the cut portion 85*a* of the line of weakening 85 intersects the lateral fold line 21, 41 at the intersection 93 so that the respective ends of the lines of weakening 85, 87 that intersect the lateral fold line 21, 41 are spaced from the edge 92 of the blank by the same distance D1.

In the illustrated embodiment, the lateral fold lines 21, 41 have a length L3 (FIG. 1) of at least approximately 188 mm (7.4 inches) and the distance D1 is at least approximately 12.6 mm (½ inch). In one embodiment, D1 is at least approximately 5 percent of the length L3. All dimensional information presented herein is intended to be illustrative of typical embodiments of the disclosure and is not intended to be limiting. Further, the various features of the blank 3 and carton 5 may have dimensions other than listed herein, without departing from the scope of this disclosure.

In the illustrated embodiment, the line of weakening 89 is a score line that extends from the intersection 93 of the oblique lines of weakening 85, 87 and the lateral fold line 21, 41. The line of weakening 89 could be other than illustrated (e.g., continuous cut-score lines, intermittent cut-score lines, etc.) without departing from the disclosure.

Figure 2:
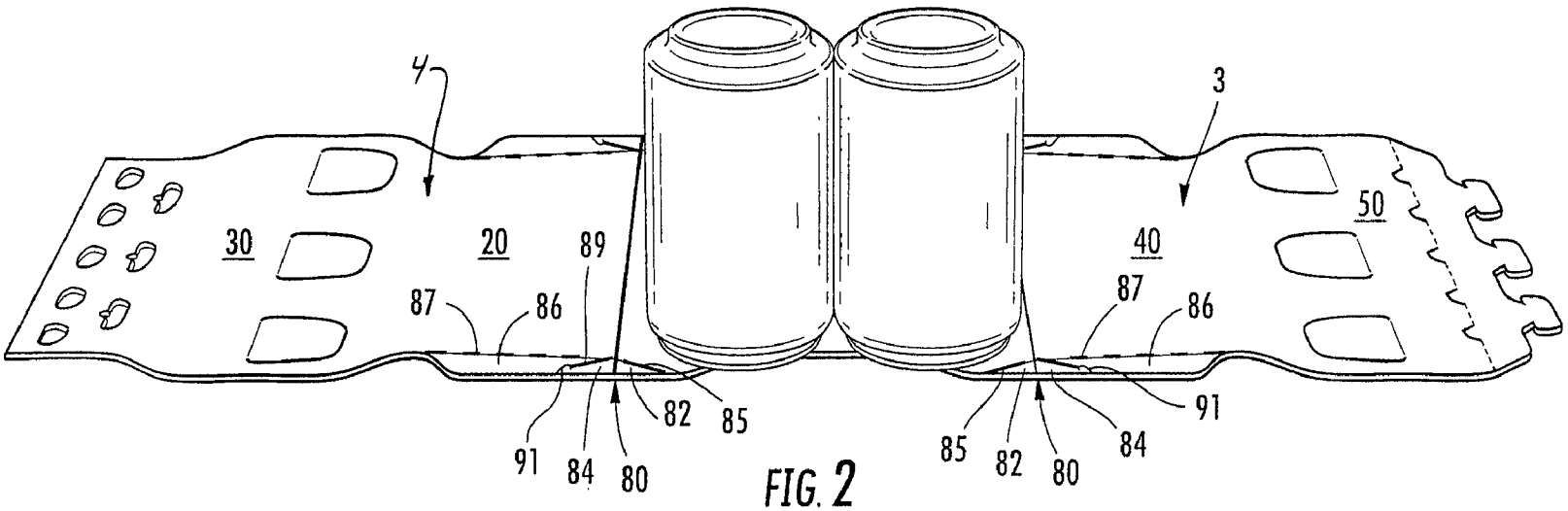
FIG. 2 is a perspective of an interior surface of the blank of FIG. 1 with containers placed thereon.
Figure 4:
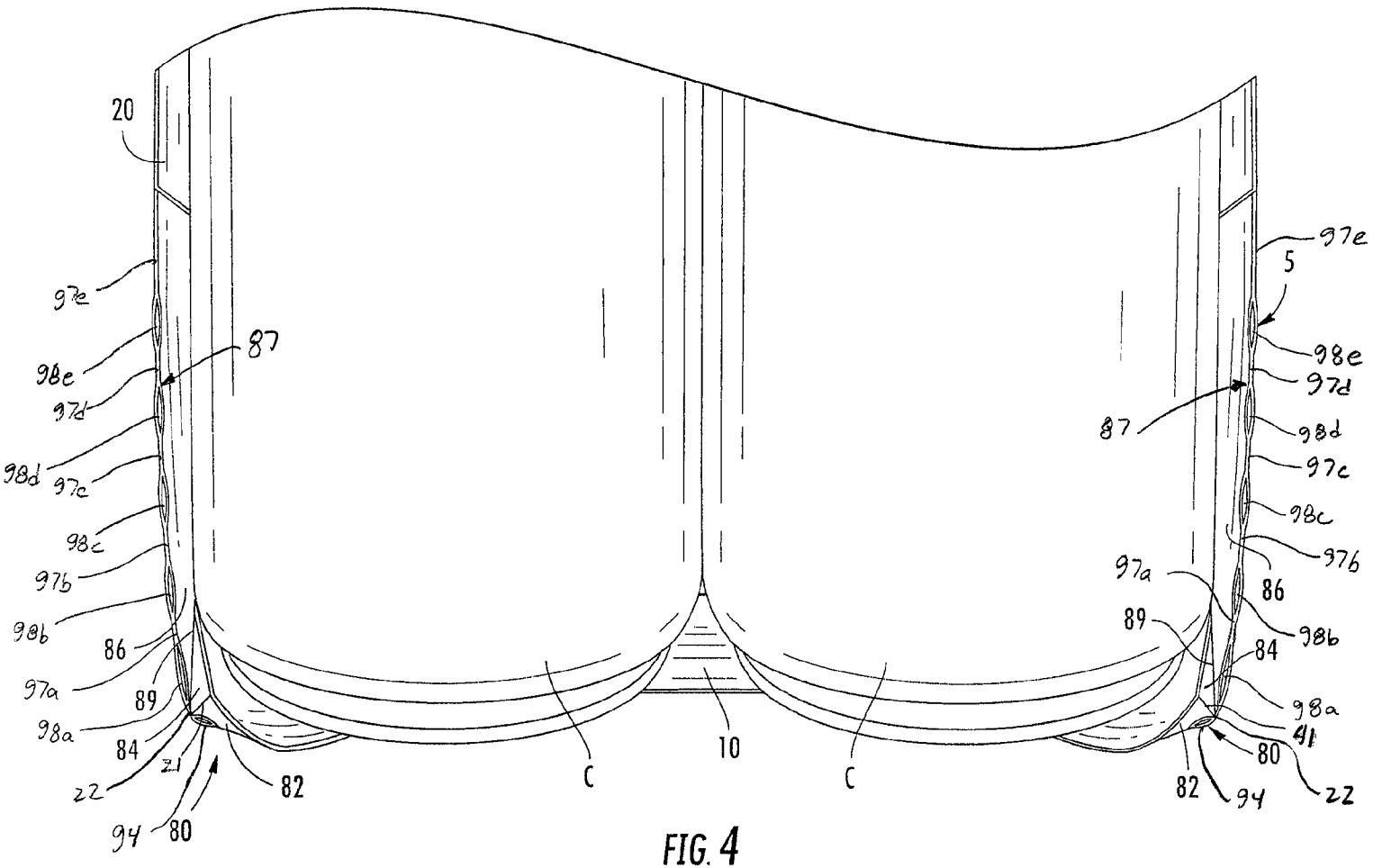
FIG. 4 is an enlarged portion of the blank of FIG. 2 that has been folded to form the carton.

An exemplary method of erecting the carton 5 will now be discussed with reference to FIGS. 2-6. FIGS. 2 and 3 illustrate an initial step in erection of the carton 5, in which containers C are placed top side down on the interior side 4 of the top panel 10 of the blank 3. Referring to FIG. 4, the side panels 20, 40 are then folded upwardly toward the containers C. As the side panels 20, 40 are folded upwardly, the tuck-in panels 86 are respectively tucked inwardly about the fold lines 87. At the same time and as a result, the side retention panels 84 are drawn inwardly and the top retention panels 82 are drawn upwardly to the position shown in FIG. 4. The top retention panels 82 and side retention panels 84 cooperate to partially wrap around portions of the containers C to respectively form the top retainers 80 at the four top corners of the carton 5. After the second bottom panel 50 is secured to the first bottom panel 30 as discussed below, the tuck-in panels 86 and retention panels 82, 84 are held in place by virtue of the tuck-in panels being respectively sandwiched (e.g., held, pinched, etc.) between the containers C and the interior surface of the side panels 20, 40.

Figure 5:
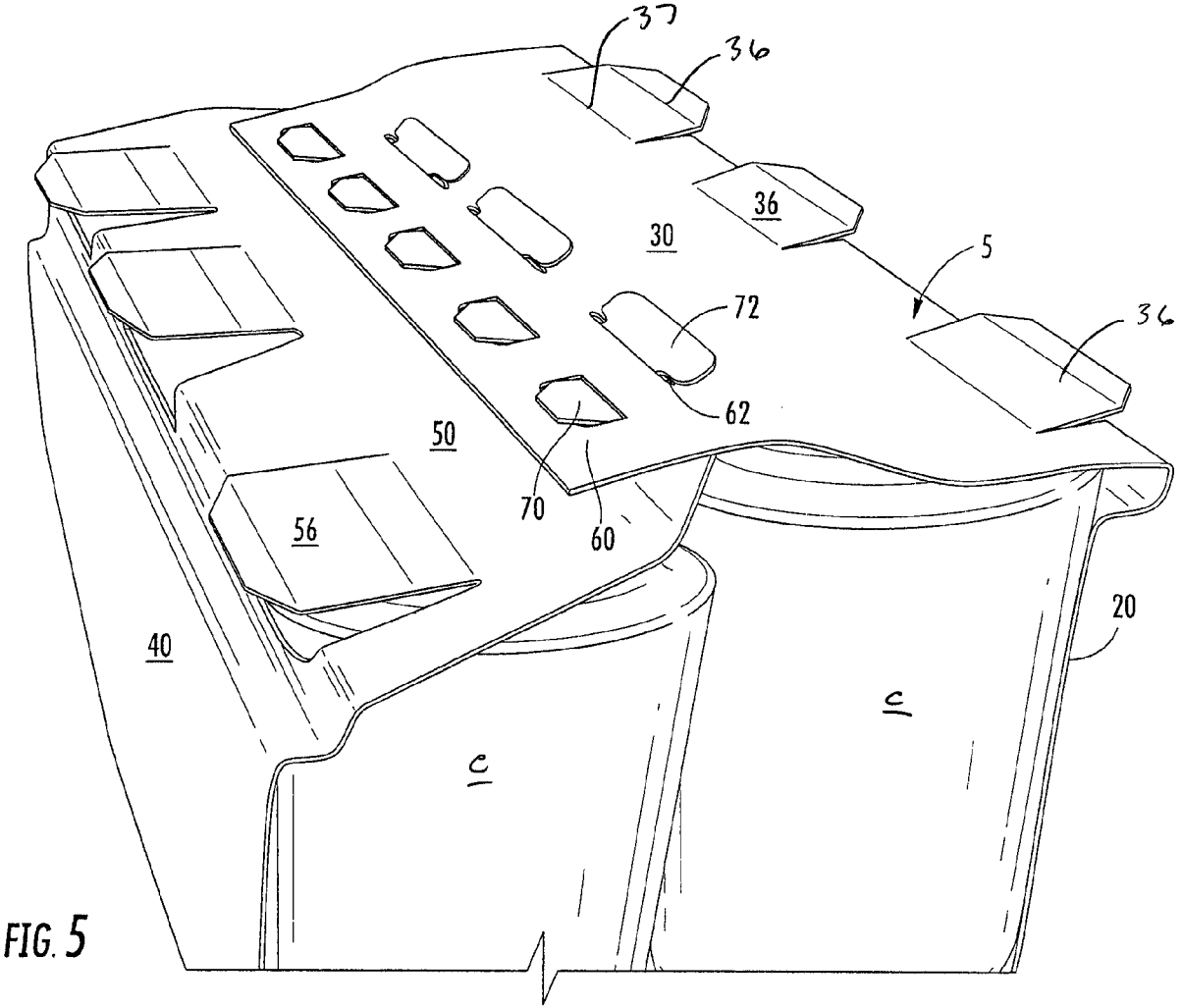
FIG. 5 is a perspective of a bottom of the carton.

As illustrated in FIG. 5, the second bottom panel 50 is secured to the first bottom panel 30 by first respectively engaging primary male locking tabs 70 with the primary female locking edges 60. The male locking flaps 72 are respectively inserted through, and cooperatively interact with, the slits 62 to further secure the second bottom panel 50 to the first bottom panel 30. The secured together bottom panels 30, 50 cooperate to form a bottom panel 90 of the carton 5. The heels of containers C are respectively associated with the cutout panels 36, 56 to allow tight wrapping of the carton 5 around containers C.

FIG. 6 shows the assembled carton 5 with the containers C removed to show the positioning of the tuck-in panels 86 and retention panels that form the top retainers 80. When the tuck-in panels 83 are folded inwardly about the fold lines 87, the retention panels 82, 84 are respectively positioned to abut a top portion of the containers C adjacent thereto to assist in retaining the containers in the carton 5. As shown in FIG. 6, the J-shaped cut 91 between each tuck-in panel 86 and side retention panel 84 allows the edge of the side retention panel adjacent the cut 91 to be independently positionable relative to the tuck-in panel. When the tuck-in panel 86 is folded inward and positioned along the interior surface of one of the side panels 20, 40, the side retention panel 84 is allowed to separate from the tuck-in panel at the J-shaped cut 91 so that the side retention panel 84 and the top retention panel 82 are positioned to retain the containers C in the carton 5.

Figure 7:
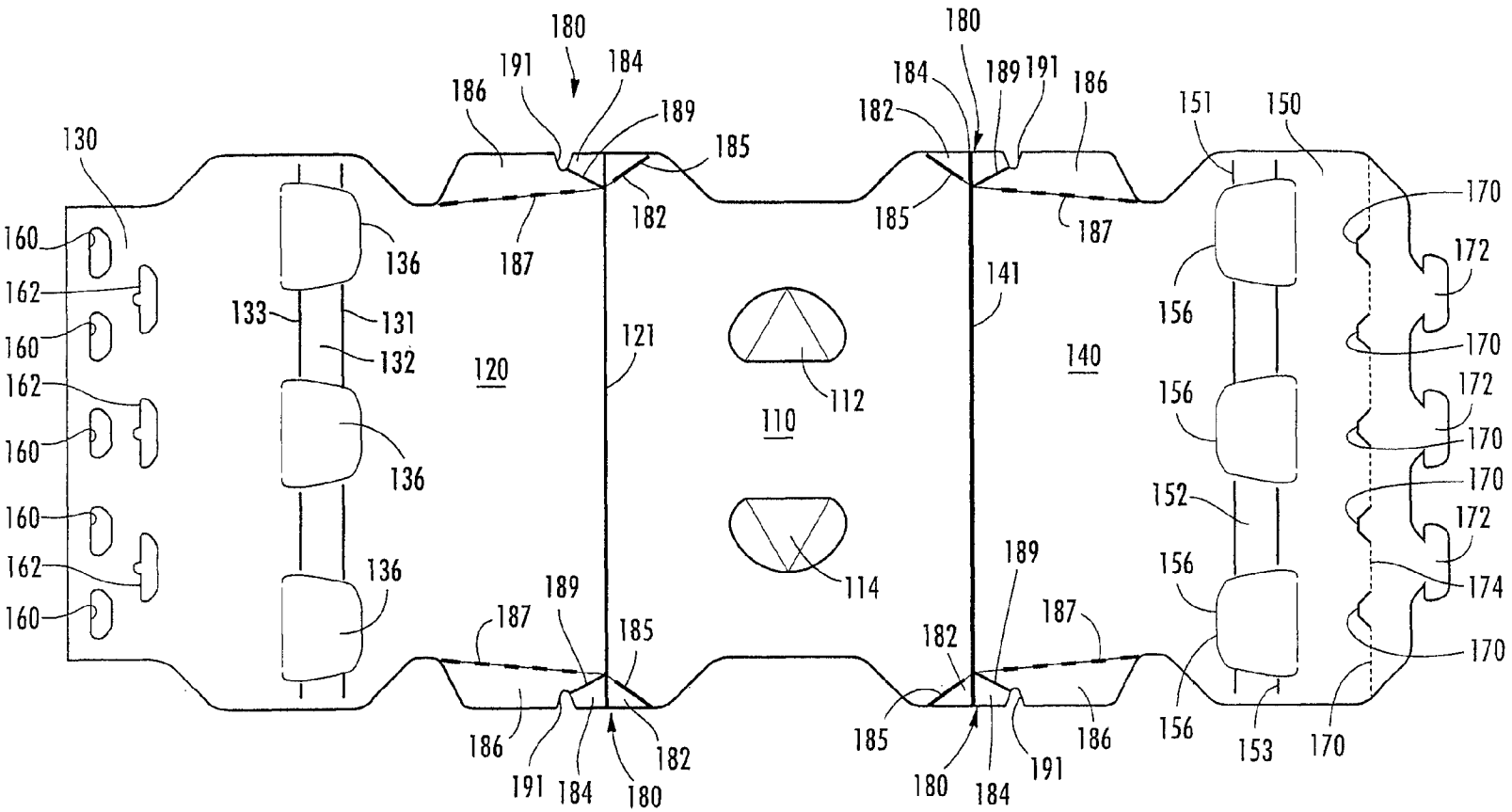
FIG. 7 is a plan view of an exterior surface of a blank used to form a carton according to a second embodiment of the disclosure.
Figure 7A:
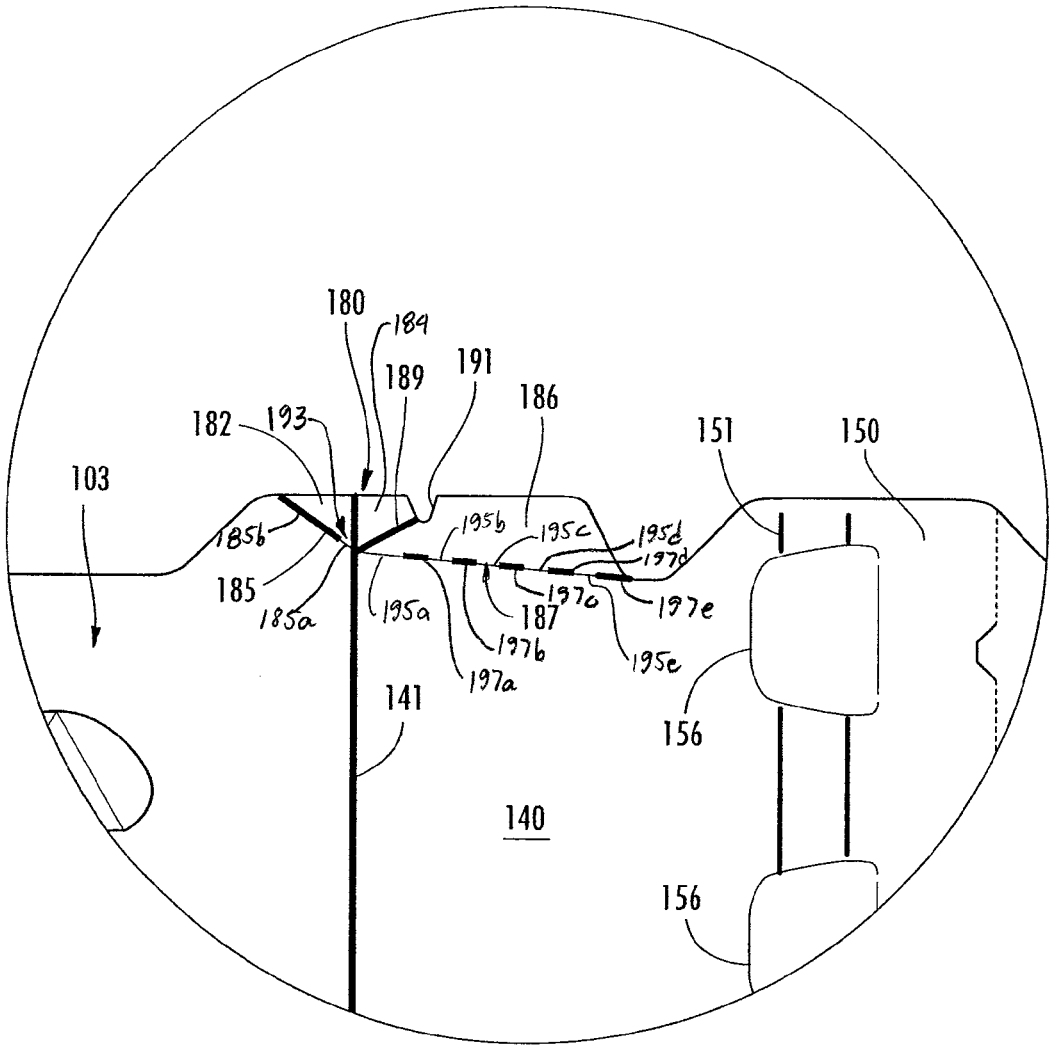
FIG. 7A is an enlarged portion of FIG. 7.

FIGS. 7 and 7A illustrate a blank 103 used to form a carton according to a second embodiment of the present disclosure. The second embodiment is like the first embodiment shown and described with reference to FIGS. 1-6, except for variations noted and other variations that would be apparent to one of ordinary skill in the art. In FIGS. 7 and 7A, like reference numbers as to the reference numbers shown in FIGS. 1-6 indicate like or similar elements, with the reference numbers in FIGS. 7 and 7A being preceded by "1." The blank 103 includes top retainers 180 similar to the top retainers 80 of the first embodiment. In the embodiments of FIGS. 7 and 7A, the tuck-in panel 186 and side retention panel 184 at each corner of the top panel 10 are separated by a notch 191 (e.g., cut out) adjacent the oblique line of weakening 189 connecting the tuck-in panel and side retention panel. The notch 191 replaces the J-shaped cut 91 of the first embodiment. Differently shaped notches 191, or the like, are within the scope of the present disclosure.

The blank according to the present disclosure can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described above. The blank can also be laminated to or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines can include: a score line, such as lines formed with a blunt scoring knife, or the like, which creates a crushed portion in the material along the desired line of weakness; a cut that extends at least partially into a material along the desired line of weakness, and/or a series of cuts that extend partially into and/or completely through the material along the desired line of weakness; and various combinations of these features The foregoing description illustrates and describes various embodiments of the present disclosure. As various changes could be made in the above construction, it is intended that all matter contained in the above description or shown in the accompanying drawings shall be interpreted as illustrative and not in a limiting sense. Furthermore, the present disclosure covers various modifications, combinations, alterations, etc., of the above-described embodiments. It will be understood by those skilled in the art that while the present disclosure has been discussed above with reference to exemplary embodiments, various additions, modifications and changes can be made thereto without departing from the spirit and scope of the claims. Furthermore, certain features and characteristics of each embodiment may be selectively interchanged and applied to other illustrated and non-illustrated embodiments without departing from the scope of the disclosure.

What is claimed is:

1. A carton for carrying a plurality of articles, the carton comprising:

a top panel;

a side panel foldably connected to the top panel at a first line of weakening;

a top retainer foldably connected to the top panel and the side panel, the top retainer comprising a top retention panel foldably connected to the top panel at a second line of weakening, a side retention panel foldably connected to the top retention panel at a portion of the first line of weakening, a tuck-in panel foldably connected to the side panel at a third line of weakening, the second line of weakening and the third line of weakening each comprising a cut-crease line having at least one cut portion and at least one score line portion, the first line of weakening has a first edge and a second edge, the first edge being spaced apart from the second edge along the length of the first line of weakening, the at least one cut portion of the second line of weakening intersects the first line of weakening at a location that is adjacent a second edge of the first line of weakening, and the at least one cut portion of the third line of weakening intersects the first line of weakening at a location that is adjacent a first edge of the first line of weakening, with respective ends of the at least one cut portion of the second line of weakening and the at least one cut portion of the third line of weakening being separated by the first line of weakening.

2. The carton of claim 1 wherein the at least one cut portion of the second line of weakening abuts the second edge at a first distance from an edge of the carton corresponding to an edge of the top retention panel, and the at least one cut portion of the third line of weakening abuts the first edge at a second distance from the edge of the carton, the second distance being substantially equal to the first distance.

3. The carton of claim 1 wherein a portion of the first line of weakening is located between respective ends of the at least one cut portion of the second line of weakening and the at least one cut portion of the third line of weakening.

4. The carton of claim 1 wherein the first line of weakening is a fold line.

5. The carton of claim 4 wherein the carton comprises a material having a thickness and the at least one cut portion of the first line of weakening and the at least one cut portion of the second line of weakening respectively extend substantially through the thickness of the material, and the fold line comprises an indentation in a surface of the material that does not extend substantially through the thickness of the material.

6. The carton of claim 3 further comprising openings respectively formed at the at least one cut portion of the second line of weakening and the at least one cut portion of the third line of weakening, the portion of the first line of weakening being located between respective openings.

7. The carton of claim 3 wherein the side retention panel is foldably connected to the tuck-in panel at a fourth line of weakening.

8. The carton of claim 7 wherein the fourth line of weakening intersects the first line of weakening at a location generally adjacent the respective ends of the second line of weakening and the third line of weakening.

9. The carton of claim 7 further comprising a cut extending from the fourth line of weakening to an edge of the carton.

10. The carton of claim 9 wherein the cut is generally J-shaped.

11. The carton of claim 7 wherein the fourth line of weakening extends from the first line of weakening to a notch at an edge of the carton.

12. The carton of claim 1 wherein the top retainer is a first top retainer at a first open end of the carton, the top retention panel is a first top retention panel, the side retention panel is a first side retention panel, the tuck-in panel is a first tuck-in panel, the carton comprises a second top retainer at a second open end of the carton, the second top retainer comprises a second top retention panel foldably connected to the top panel, a second side retention panel foldably connected to the top retention panel, and a second tuck-in panel foldably connected to the side panel.

13. The carton of claim 12 further comprising containers in the carton, one of the containers being adjacent to the first top retainer and being retained in the carton by contact with the first top retention panel and the first side retention panel, and one of the containers being adjacent to the second top retainer and being retained in the carton by contact with the second top retention panel and the second side retention panel.

14. A blank for forming a carton for holding a plurality of articles, the blank comprising:

a top panel;

a side panel foldably connected to the top panel at a first line of weakening;

retainer features foldably connected to the top panel and the side panel, the retainer features comprising a top retention panel foldably connected to the top panel at a second line of weakening, a side retention panel foldably connected to the top retention panel at a portion of the first line of weakening, a tuck-in panel foldably connected to the side panel at a third line of weakening, the second line of weakening and the third line of weakening each comprising a cut-crease line having at least one cut portion and at least one score line portion, the first line of weakening has a first edge and a second edge, the first edge being spaced apart from the second edge along the length of the first line of weakening, the at least one cut portion of the second line of weakening intersects the first line of weakening at a location that is adjacent a second edge of the first line of weakening, and the at least one cut portion of the third line of weakening intersects the first line of weakening at a location that is adjacent a first edge of the first line of weakening, with respective ends of the at least one cut portion of the second line of weakening and the at least one cut portion of the third line of weakening being separated by the first line of weakening.

15. The blank of claim 14 wherein the at least one cut portion of the second line of weakening abuts the second edge at a first distance from an edge of the blank corresponding to an edge of the top retention panel, and the at least one cut portion of the third line of weakening abuts the first edge at a second distance from the edge of the blank, the second distance being substantially equal to the first distance.

16. The blank of claim 14 wherein a portion of the first line of weakening is located between respective ends of the at least one cut portion of the second line of weakening and the at least one cut portion of the third line of weakening.

17. The blank of claim 16 wherein the side retention panel is foldably connected to the tuck-in panel at a fourth line of weakening.

18. The blank of claim 17 wherein the fourth line of weakening intersects the first line of weakening at a location generally adjacent the respective ends of the second line of weakening and the third line of weakening.

19. The blank of claim 18 further comprising a cut extending from the fourth line of weakening to an edge of the blank, the cut being generally J-shaped.

20. The blank of claim 18 wherein the fourth line of weakening extends from the first line of weakening to a notch at an edge of the blank.

21. The blank of claim 14 wherein the first line of weakening is a fold line and the blank comprises a material having a thickness, the at least one cut portion of the first line of weakening and the at least one cut portion of the second line of weakening respectively extend substantially through the thickness of the material, and the fold line comprises an indentation in a surface of the material that does not extend substantially through the thickness of the material.

* * * * *